US006033842A

United States Patent [19]

Lok et al.

[11] Patent Number: 6,033,842

[45] Date of Patent: Mar. 7, 2000

[54] PREPARATION OF SILVER CHLORIDE EMULSIONS HAVING IODIDE CONTAINING GRAINS

[75] Inventors: Roger Lok, Rochester; Benjamin T. Chen, Penfield; Weimar W. White, Canaseraga, all of N.Y.

[73] Assignee: Eastman Kodak Company, Rochester, N.Y.

[21] Appl. No.: 09/218,807

[22] Filed: Dec. 22, 1998

[51] Int. Cl.[7] ..... G03C 1/015; G03C 1/08

[52] U.S. Cl. ..... 430/569; 430/567; 430/599

[58] Field of Search ..... 430/567, 569, 430/599

[56] References Cited

U.S. PATENT DOCUMENTS

| | | | |
|---|---|---|---|
| 5,389,508 | 2/1995 | Takada et al. | 430/567 |
| 5,418,124 | 5/1995 | Suga et al. | 430/567 |
| 5,525,460 | 6/1996 | Maruyama et al. | 430/567 |
| 5,527,664 | 6/1996 | Kikuchi et al. | 430/569 |
| 5,547,827 | 8/1996 | Chen et al. | 430/567 |
| 5,726,005 | 3/1998 | Chen et al. | 430/567 |
| 5,728,005 | 3/1998 | Edwards et al. | 430/567 |
| 5,736,310 | 4/1998 | Chen et al. | 430/567 |
| 5,736,312 | 4/1998 | Jagannathan et al. | 430/569 |
| 5,792,601 | 8/1998 | Edwards et al. | 430/567 |
| 5,866,314 | 2/1999 | Royster, Jr. et al. | 430/569 |

*Primary Examiner*—Mark F. Huff
*Attorney, Agent, or Firm*—Paul A. Leipold

[57] ABSTRACT

The invention relates to a method of forming a silver halide emulsion comprising adding triiodide during grain formation or sensitization.

22 Claims, No Drawings

PREPARATION OF SILVER CHLORIDE EMULSIONS HAVING IODIDE CONTAINING GRAINS

FIELD OF THE INVENTION

The invention relates to a process of preparing iodide containing radiation-sensitive silver halide emulsions useful in photography.

DEFINITION OF TERMS

In referring to grains and emulsions containing two or more halides, the halides are named in order of ascending concentrations.

The term "silver iodohalide" in referring to grains or emulsions indicates a grain structure in which silver chloride and/or bromide provide a face centered cubic rock salt crystal lattice structure containing iodide ions.

The term "iodine" refers to the diatomic and neutral element.

The term "iodide" refers to the negatively charged ionic monoatomic species.

The term "triiodide" refers to the negatively charged ionic triatomic species formed from iodine and iodide ion.

The term "high chloride" in referring to grains and emulsions indicates that chloride is present in a concentration of greater than 50 mole percent, based on total silver.

The term "low surface iodide" in referring to grains indicates that iodide is present in a concentration of less than 2 mole percent, based on silver within 0.02 $\mu$m of the surface of the grains.

*Research Disclosure* is published by Kenneth Mason Publications, Ltd., Dudley House, 12 North St., Emsworth, Hampshire PO10 7DQ, England.

BACKGROUND OF THE INVENTION

In the most widely employed form of photography, images are captured by a photographic element comprised of a support and at least one emulsion layer comprised of radiation-sensitive silver halide grains. The radiation-sensitive grains are prepared by reacting halide ions with silver ions in a dispersing medium. Silver chloride, silver bromide, and silver iodide are known to be useful alone or in combination to form the radiation-sensitive grains.

Silver iodide grains exhibit β or γ phase crystal lattice structures that can accommodate only minor amounts of silver bromide and/or chloride. Difficulties with development have severely limited the use of these grains for latent image capture in photography.

Silver chloride and silver bromide each forms a face centered cubic rock salt crystal lattice structure. All relative proportions of chloride and bromide ions can be accommodated in this crystal lattice structure. Iodide ion can be accommodated up to its saturation limit, which is approximately 40 mole percent, based on total silver in a silver bromide crystal lattice structure, and up to about 13 mole percent, based on silver in a silver chloride crystal lattice structure, the exact limit varying within a few percent, based on temperature.

A large proportion of photographic emulsions contains silver iodohalide grains, that is, grains in which a significant, performance modifying concentration of iodide is contained in a face centered cubic rock salt crystal lattice structure formed by one or both of the silver chloride and bromide. The highest levels of photographic sensitivity are typically realized by providing high bromide grains containing a minor amount of iodide, such as silver iodobromide grains. The presence of minor amounts of iodide ion can also enhance the sensitivity of high chloride grains. It is disclosed in U.S. Pat. Nos. 5,547,827; 5,726,005; 5,736,310; and 5,728,516 that iodochloride emulsions may be formed that have improved speed. These emulsions have the iodide incorporated at or below the surface of the grains.

To appreciate the techniques and difficulties for preparing mixed halide grains that contain iodide, it is necessary to appreciate the relative solubilities of the different photographically useful silver halides.

Although the majority of the silver and halide ions are confined to the grains, at equilibrium a small fraction of the silver and halide ions is also present in the dispersing medium, as illustrated by the following relationship:

$$Ag^+ + X^- \rightleftharpoons AgX \quad \text{(I)}$$

where X represents halide. From relationship (I) it is apparent that most of the silver and halide ions at equilibrium are in an insoluble form, while the concentration of soluble silver ions ($Ag^+$) and halide ions ($X^-$) is limited. However, it is important to note that equilibrium is a dynamic relationship, that is, a specific halide ion is not fixed in either the right-hand or left-hand position in relationship (I). Rather a constant interchange of halide ion between the left- and right-hand positions is occurring.

At any given temperature the activity product of $Ag^+$ and $X^-$ is at equilibrium a constant and satisfies the relationship:

$$Ksp=[Ag^+][X^-] \quad \text{(II)}$$

where Ksp is the solubility product constant of the silver halide. To avoid working with small fractions, the following relationship is also widely employed:

$$-\log Ksp=pAg+pX \quad \text{(III)}$$

where pAg represents the negative logarithm of the equilibrium silver ion activity and pX represents the negative logarithm of the equilibrium halide ion activity. From relationship (III) it is apparent that the larger the value of the −log Ksp for a given halide, the lower is its solubility. The relative solubilities of the photographic halides (Cl, Br, and I) can be appreciated by reference to Table A:

TABLE A

| Temp. ° C. | AgCl -log Ksp | AgBr -log Ksp | AgI -log Ksp |
|---|---|---|---|
| 40 | 9.2 | 11.6 | 15.2 |
| 50 | 8.9 | 11.2 | 14.6 |
| 60 | 8.6 | 10.8 | 14.1 |
| 80 | 8.1 | 10.1 | 13.2 |

From Table A it is apparent that at 40° C. the solubility of AgCl is one million times higher than that of AgI, while the solubility of AgBr ranges from about one thousand to ten thousand times that of AgI.

When silver ion and two or more halide ions are concurrently introduced into a dispersing medium, the silver ion precipitates disproportionately with the halide ion that forms the least soluble silver halide. It is therefore appreciated that the presence of local iodide ion concentration variances in the dispersing medium in the course of precipitation of silver iodohalide grains result in iodide ion non-uniformities in the grains precipitated. When the limited ability of a face centered cubic rock salt crystal lattice structure to accommodate iodide ions is taken into account, it is readily appreciated that if iodide ion non-uniformities in the dispersing medium are sufficiently large, a separate, unwanted high iodide (β or γ phase) grain population can be produced.

In the large scale precipitation of iodochloride emulsions, a mixing sensitivity problem arises. This occurs when KI is used as the source of iodide in precipitating the iodochloride emulsion. The rate of reaction between iodide ion and silver ion is much faster than the rate of dispersion of the potassium iodide reactant. The latter rate is dependent on the amount of the KI dispersed, the rate of blending, and the kettle volume. This results in the uneven distribution of the iodide ion from grain to grain and from batch to batch depending on the rate of mixing and thus the rate of dispersion. The resulting silver iodochloride emulsion thus varies in photographic performance and lacks manufacturability control.

As a technique for better controlling the uniformity of iodide ion availability within the dispersing medium, it has been recently suggested (see Takada et al U.S. Pat. No. 5,389,508; Suga et al U.S. Pat. No. 5,418,124; Maruyama et al U.S. Pat. No. 5,525,460; and Kikuchi et al U.S. Pat. No. 5,527,664) that the uniformity of iodide ion within the dispersing medium can be better controlled by introducing iodide in the form of a compound satisfying the formula:

$$R—I \qquad (IV)$$

wherein R represents a monovalent organic residue which releases iodide upon reacting with a nucleophilic reagent, such as hydroxide, or sulfite ion or ammonia. Hydroxide ion and ammonia are basic species that are known to cause a rise in pH. An increase in pH has been demonstrated to produce fog in emulsion making. Such fog formation is non-discriminatory and gives rise to poor image in the art of silver halide photography. Additionally, formation of sulfite anion, a silver halide grain ripening agent, may lead to changes in grain morphology.

U.S. Pat. No. 5,726,005 describes photographic elements containing cubical grain silver iodochloride emulsions. U.S. Pat. No. 5,736,310 teaches the preparation of cubical grain silver iodochloride emulsions and processes. U.S. Pat. No. 5,792,601 of Edwards et al discloses a process for the preparation of iodochloride emulsions with incorporated iridium dopant. U.S. Pat. No. 5,736,312 of Jagannathan et al discloses a process for introducing iodide ion into the crystal lattice of silver halide grains by reacting an iodate ($IO_3^-$) anion with a sulfite anion, a known silver halide grain ripening agent.

The organic ligand release (see formula IV above) approach for introducing iodide into silver halide grain crystal lattice structures, as well as the Jagannathan et al approach of employing iodate ($IO_3^-$) anion, has significant disadvantages. In order to release iodide ion by these methods either a strong grain ripening agent, such as sulfite ion, or an elevated pH is required. Elevated pH conditions risk undesirably elevating fog levels in the emulsions. This occurs because the conditions are favorable for a portion of the silver ions, $Ag^+$, being reduced to $Ag^\circ$. When a few $Ag^\circ$ atoms are located in close proximity, the grain can spontaneously develop, independent of its exposure. This is sometimes referred to as reduction fog or R-typing.

The requirement of a sulfite anion is particularly undesirable, since sulfite is known to act as a grain ripening agent. That is, it tends to speed the ripening out of smaller grains onto larger grains and the preferential solubilization of grain edge and corner structures. This can have an undesirable effect of changing the shape of the grains. For example, where it is desired to maximize a particular class of external crystal faces, such as {111} or {100} faces, ripening can have the effect of rounding edges and comers to decrease the proportion of clearly {111} or {100} grain faces. This same edge and corner rounding can also degrade grain shapes, such as well-defined cubic, octahedral, or tabular grains, causing regression toward spherical forms as a function of the degree of ripening that has occurred.

The use of iodate ($IO_3^-$) ion to release iodide ($I^-$) anion, as taught by Jagannathan et al, is relatively inefficient, since three sulfite anions are required to release a single iodide ($I^-$) anion, as illustrated by the following equation:

$$IO_3^- + 3SO_3^= \rightarrow I^- + 3SO_4^= \qquad (V)$$

Thus, to arrive at a 3 mol percent iodide concentration in the grains by the process of Jagannathan et al, it is necessary to introduce nearly 10 mol percent sulfite ion, based on silver. This is a high proportion of sulfite ion.

Finally, the water solubility of iodine is very limited. At 20° C., iodine is soluble in water only at 0.029 g per 100 mL (Handbook of Chemistry and Physics). To achieve a higher solubility, the use of alcoholic solvents are suggested. However, the use of these organic solvents are environmentally hazardous and are not recommended. Additionally, iodine is a very volatile solid. It sublimes easily at room temperature to the vapor state. This volatility makes it difficult to control the exact quantities needed in the large-scale manufacturing of AgICI emulsions.

PROBLEM TO BE SOLVED BY THE INVENTION

There is a need for a method of introducing iodide in the silver chloride grain without using materials that have the disadvantage of causing deleterious photographic effects.

SUMMARY OF THE INVENTION

It is an object of the invention to overcome disadvantages of prior methods of forming iodochloride grains.

It is another object to precipitate iodochloride grains that have improved photographic characteristics.

It is a further object to provide silver iodochloride grains that have improved speed.

These and other objects of the invention generally are accomplished by a method of forming a silver emulsion comprising precipitating silver chloride grains with the proviso that during precipitation, triiodide is added during grain formation or sensitization.

ADVANTAGEOUS EFFECT OF THE INVENTION

Thus, the use of triiodide as a source of iodide ion makes more efficient use of materials, starting with a readily available material and eliminating iodide compound components that require the use of deleterious materials for iodide release. To this significant advantage is added the further advantage that triiodide provides a source of iodide ion under mild conditions that avoid both the risks of reduction fog and grain ripening, with their known attendant disadvantages to grain characteristics and performance.

DETAILED DESCRIPTION OF THE INVENTION

The invention has numerous advantages over prior practices in the art. The invention provides a silver iodochloride emulsion that does not require the use of chemicals for release of iodide ion. Some of these materials may have potentially deleterious photographic effects such as indiscriminate fog formation and/or grain morphology changes. With the addition of triiodine rather than an organic iodo compound, the formation of organic by-products is avoided. This has the advantage of eliminating the possibility of such by-products having undesirable photographic effects. These and other advantages will be apparent from the detailed description below.

In one aspect this invention is directed to a process of preparing a photographically useful emulsion, containing gelatin as the dispersing medium and radiation-sensitive silver iodochloride grains, comprised of simply dissolving a triiodide salt in water and introducing the solution of triiodide into the growth kettle and maintaining the dispersing medium within a pH range of from 5 to 6 to release I for incorporation into the crystal lattice structure. The invention also has the advantage that the iodide may be added without the use of a solvent other than water. This is advantageous in that water is a compound already present in the emulsion and does not have a photographic effect. Further, there is an advantage in reducing solvents in the formation of photographic material, as their removal with environmental protection adds to the cost of the photographic elements.

Triiodide ($I_3^-$) as a source of iodide ion ($I^-$) shares with formula IV R—I compounds and iodate ($IO_3^-$) the advantage of avoiding excessive local iodide ion concentrations at the point of addition into the dispersing medium within the reaction vessel.

A fundamental advantage of introducing triiodide ($I_3^-$) rather than a formula IV R—I compound, as noted above, is that introduction of the R- moiety is eliminated along with its reaction by-product. Therefore, the potential for by-product unwanted interactions with other ingredients in the dispersing medium present during precipitation and added after precipitation is either eliminated or minimized. This is because triiodide releases iodine and iodide as shown in the following equation:

$$I_3^- \rightarrow I^- + I_2 \qquad \text{(VI)}$$

A further advantage is that no reducing agent or uncommon starch peptizing agent is required to release $I^-$ for incorporation into the grains. As demonstrated in the Examples, the employment of hydrophilic colloids such as starch used as peptizers for the purpose of reacting with iodine is avoided.

Thus, the use of triiodide as a source of iodide ion ($I^-$) makes more efficient use of materials; starts with readily available materials that are water soluble and environmentally friendly; and eliminates iodide compound components that serve only to form reaction by-products. To this significant advantage is added the further advantage that iodine provides a source of iodide ion ($I^-$) under conditions that avoid both the risks of reduction fog and grain ripening, with their known attendant disadvantages to grain characteristics and performance.

Conventionally, grain precipitation is initiated by adding to the dispersing medium within the reaction vessel a small amount of a bromide or chloride salt, such as alkali, alkaline earth or ammonium halide salt, contemplated to be later introduced during precipitation. This assures a stoichiometric excess of halide ion with respect to silver ion at the initiation of precipitation.

Subsequently a soluble silver salt, such as silver nitrate, is introduced through a first jet. A soluble iodide salt, such as an alkali, alkaline earth, or ammonium iodide salt, is introduced through a second jet. Chloride and/or bromide ions can be introduced through the second jet with the iodide or introduced through one or more separate jets. If sufficient chloride and/or bromide salt is initially placed in the reaction vessel, it is possible to dispense with further chloride and/or bromide addition. In most instances, chloride and/or bromide ions are introduced into the reaction vessel concurrently with the introduction of silver ion.

In one embodiment of the invention, grain formation comprises precipitating carried out at a pH of between 5 and 6. In another embodiment, grain formation is carried out at a temperature of between 50 and 70° C. In another embodiment, all triiodide is added during grain formation in a period of between 1 and 30 seconds. In another embodiment, all triiodide is added during grain formation in the time of between 1 and 10 seconds.

The presence of iodide in the reaction vessel is limited in relation to the chloride present in the reaction vessel so that silver iodochloride grains are precipitated exhibiting a face centered cubic rock salt crystal lattice structure. This is achieved by limiting iodide addition to less than the saturation level of iodide ion in the silver chloride and/or bromide crystal lattice being formed by precipitation.

While iodide ion constitutes only a minor component of the silver iodochloride grains, its concentration and distribution can significantly influence photographic performance. While iodide concentrations can range up to saturation levels in the face centered cubic rock salt crystal lattice structure, for most photographic applications iodide levels are limited to low iodide levels, typically ranging from about 0.05 to 10 (preferably 0.01 to 6.0) mol percent, based on silver.

Both uniform and non-uniform iodide distributions are common, as illustrated by *Research Disclosure*, Item 38957, cited above, I. Emulsion grains and their preparation, A. Grain halide composition, paragraph (4). Typically low surface iodide concentrations are desired, although Chaffee et al U.S. Pat. No. 5,358,840 illustrates advantageous photographic properties with a maximum iodide concentration at the surface of the grains.

The silver iodochloride grains produced by the process of the invention can take any conventional shape. Illustrations of varied forms of silver iodohalide grains are provided by *Research Disclosure*, Item 38957, cited above, I. Emulsion grains and their preparation, B. Grain morphology.

The process of the present invention can be practiced by modifying conventional silver iodohalide emulsion precipitations of the type described above by substituting triiodide addition for all or any portion of the soluble iodide salt conventionally introduced in aqueous solution during grain precipitation, including halide conversion. The triiodide also may be introduced during sensitization.

Trilodides may be available in the form of ammonium triiodide, potassium triiodide, rubidium triiodide, and cesium triiodide. The latter two triiodides are commercially available, while the first two may be prepared from their corresponding iodides and iodine. The method of preparation simply involves stirring a suitable amount of solid iodine in a solution of an alkaline metal iodide for a duration of time until the iodine is dissolved. After the iodide is consumed by reacting with the silver ion, the remaining iodine may react with the gelatin peptizer as described in application Ser. No. 09/218,315. That is, the reactions may be quite complex, because of the multitude of reactive components present in the peptide chain. It may be speculated that the methionine group reacts with iodine in the following manner:

$$3I_2+2RSMe+3H_2O \rightarrow 6I^-+RS(O)Me+RS(O)_2Me+6H^+ \quad (VII)$$

where

R is the residue of the methionine group in the peptide chain of the gelatin.

Whatever the reactions of iodine with gelatin may be, the reaction goes to completion, efficiently converting iodine introduce to iodide ion ($I^-$). However, the reactions are not instantaneous. The constant removal of the iodide ion from the dispersing medium by incorporation in the grains drives the reactions. In conventional silver iodohalide grain precipitations, grains that happen to impinge upon the point of iodide ion introduction encounter higher iodide ion concentrations than the remainder of the grains, resulting in grain-to-grain variances in iodide levels and, often, variations in the structural form and photographic performance of the grains. Delaying iodide ion release during triiodide introduction, thereby allowing distribution of triiodide within the dispersing medium, local grain-to-grain and unintended intragrain variances in iodide content are entirely avoided.

Similarly, in the large scale precipitation of iodochloride emulsions, the delayed formation of iodide ion allows a more uniform distribution of the iodine before the iodide combines with the silver ion. The result is a silver iodochloride emulsion that has a much less degree of variability in terms of iodide distribution within the grain and intergrain. Overall, a more robust emulsion results and improved photographic performance.

From formula (VII) it is apparent that the conversion of iodine to iodide ion results in the formation of hydrogen ion ($H^+$) as a by-product. In the art of silver halide precipitation, formation of atomic silver species from the reduction of silver ion may lead to the undesirable formation of fog. Such formation, however, is retarded when the pH of the emulsion medium is lowered, that is, a more acidic medium retards the formation of atomic silver as expressed in (VIII).

$$2Ag^\circ+\tfrac{1}{2}O_2+2H^+=2Ag^++H_2O \quad (VIII)$$

It is appreciated that when triiodide is used as the source of iodide, the propensity to fog formation is also reduced as a result of generation of hydrogen ion.

Although the invention has been described in terms of substituting triiodide for a water soluble iodide salt in preparing a silver iodochloride emulsion, it is appreciated that triiodides can be alternatively substituted for an organic iodide compound (R—I) employed without the need for an additional reducing reagent or in combination with a starch peptizer that is costly and difficult to manufacture.

To maximize the localization of crystal lattice variances produced by iodide incorporation, it is preferred that the solution of triiodide be introduced as rapidly as possible. That is, in order to form the maximum iodide concentration in the desired region of the grains, the triiodide solution is preferably introduced in 1 to 50 seconds. Preferably, it is added in between 1 and 30 seconds. The optimum time is between 1 and 10 seconds for best creation of lattice defects without crystal rearrangement. When the triiodide is introduced more slowly, somewhat higher amounts of incorporated iodide (but still within the ranges set out above) are required to achieve speed increases equal to those obtained by more rapid iodide introduction and minimum density levels are also higher.

In one embodiment of the invention, triiodide addition is at a pH of between 5 and 6. In another embodiment of the invention, triiodide addition is at a temperature of between 60 and 66° C. In a further embodiment, triiodide addition is at a vAg of 100 to 120 millivolts. In a further embodiment where triiodide addition is at a temperature of between 60 and 66° C., the triiodide is added between after 90 mol percent to 97 mol percent of the total silver chloride for forming the silver halide emulsion has been precipitated. In a further embodiment the triiodide is added when about 0.00166 percent to 1 percent of the total silver halide for forming the silver halide emulsion has been precipitated. In a further embodiment the triiodide is added when about 0.01 percent to 0.166 percent of the total silver halide for forming the silver halide emulsion has been precipitated. In a further embodiment, the triiodide is added after 85 mol percent of the total silver halide for forming the silver halide emulsion has been precipitated.

Instead of introducing iodide into the grains as they are being formed, it is recognized that iodide can be used to form silver iodohalide grains by halide conversion. During halide conversion, iodide ion ($I^-$) is released from triiodide in a dispersing medium containing silver halide grains having a face centered cubic rock salt crystal lattice structure while withholding the addition of silver. Thus, the process of the invention can be readily adapted to any conventional halide conversion process. Conventional techniques for halide conversion are illustrated by *Research Disclosure*, Item 38957, cited above, I. Emulsion grains and their preparation, A. Grain halide composition, paragraph (8).

Apart from the features that have been specifically discussed, the high chloride grain emulsions can contain selections of dopants, peptizers, vehicles, and hardeners. Once prepared, the emulsions can be chemically sensitized, spectrally sensitized, combined with antifoggants and stabilizers, image dye providing components, and other conventional photographic addenda. Such conventional features are illustrated by *Research Disclosure*, Vol. 389, September 1996, Item 38957.

The following examples illustrate the practice of this invention. They are not intended to be exhaustive of all possible variations of the invention. Parts and percentages are by weight unless otherwise indicated.

EXAMPLES

Preparation of Potassium Triiodide

A solution of 90.60 grams of KI in 550 mL of high purity water was stirred in a 4-L volumetric flask. To this solution was added 52.00 grams of high purity small size iodine crystals through a funnel. Additional water was used to completely transfer the crystals into the flask. The flask was immediately stoppered and the solution slowly stirred until the crystals were completely dissolved. (This may take several hours or overnight). More water was added until the flask contained about 3.95 L. The solution was stirred for an additional hour, when the magnetic stirrer was removed and rinsed. Finally, the volume was brought to the 4 L mark and mixed thoroughly by hand.

Other triiodides such as rubidium and cesium triiodides are commercially available.

PART I. EMULSION MAKING

Emulsion A (Control Cubic Grain AgCl Emulsion)

A stirred tank reactor containing 6.65 Kg of distilled water and 201 g of bone gelatin was brought to a pAg of 7.15 with 2.0 M solution of NaCl. The mixture was heated to 68.3° C. when 1,8-dihydroxy-3,6-dithiaoctane (1.65 g) was added to the reactor 30 seconds before the double jet addition of a solution of 3.722 M $AgNO_3$ (at 39.9 mL per min) and a solution of 3.8 M NaCl at a rate such that a constant pAg of 7.15 was maintained. The silver jet addition rate remained at 39.9 mL per min for 5.25 min, then it was accelerated to 80.3 mL per min over a period of 7.5 min while the salt stream was adjusted such that the pAg was held constant at 7.15. The silver jet addition rate remained at 80.3 mL per min for another 25.3 min while the pAg was maintained at 7.15. A total of 10 moles of AgCI was precipitated in the form of a monodispersed cubic grain emulsion having a mean grain size of 0.76 μm.

Emulsion B (Example of AgCl/I Emulsion, 0.3 M % KI after 93% of Ag)

The emulsion was prepared similar to Emulsion A, except that after the accelerated flow rate of 80.3 ml per min was established, the silver jet addition was held at this rate for 22.9 min with pAg held at 7.15, resulting in the precipitation of 93 percent of the total silver to be introduced. At this point, 200 mL of KI solution that contained 4.98 g KI was dumped into the reactor. The silver and chloride salt additions following the dump were continued as before the dump for another 2.33 min. A total of 10 moles of AgCl/I emulsion containing 0.3 mole percent iodide was obtained. The emulsion contained monodispersed tetradecahedral grains with average grain size of 0.74 μm.

Emulsion C (Example of AgCl/I Emulsion, 0.3 M % $CsI_3$ after 93% of Ag)

The emulsion was prepared similarly as Emulsion B , except that 15.41 g of $CsI_3$ was dumped into the reactor. A total of 10 moles of AgCl/I emulsion containing 0.3 mole percent iodide was precipitated. The emulsion contained monodispersed tetradecahedral grains with average grain size of 0.77 μm.

Emulsion D (Example of AgCl Emulsion with $HgCl_2$)

The emulsion was prepared similar to Emulsion A except that the $AgNO_3$ solution used in the double jet precipitation contained $HgCl_2$ in the amount of 0.29 μmole per silver mole. A total of 10 moles of AgCl was precipitated in the form of a monodispersed cubic grain emulsion having a mean grain size of 0.79 μm.

Emulsion E (Example of AgCl/I Emulsion; 0.3 M % $CsI_3$ (Formed by Mixing $CsI/I_2$=1/1) after 90% of Ag)

The emulsion was prepared similar to Emulsion C except that the $CsI_3$ was prepared from a mixture of CsI and $I_2$ at a molar ratio of $CsI/I_2$=1/1, and a total of 0.3 M % $CsI_3$ was used in the dump iodide operation. A total of 10 moles of AgCl/I was prepared in the form of a monodispersed tetradecahedral grains with average grain size of 0.77 μm, and an iodide content of 0.3 mole percent.

Emulsion F (Example of AgCl/I Emulsion, 0.3 M % $RbI_3$ after 93% of Ag)

The emulsion was prepared similar to Emulsion C , except that 13.99 g of $RbI_3$ (a total of 0.3 M %) was dumped into the reactor instead of $CsI_3$. A total of 10 moles of AgCl/I emulsion was precipitated in the form of monodispersed tetradecahedral grains with average grain size of 0.77 μm.

Emulsion G (Example of AgCl/I Emulsion, 0.3 M % $KI_3$ after 93% of Ag).

The emulsion was prepared similar to Emulsion C, except that the $KI_3$ solution was made from a mixture of KI and $I_2$ at the molar ratio of $KI/I_2$ R=1/1, and a total of 0.3 M % $KI_3$ was dumped into the reactor. A total of 10 moles of AgCl/I emulsion was precipitated in the form of a monodispersed tetradecahedral grains with average grain size of 0.78 μm.

Emulsion H (Example of AgCl/I Emulsion; 0.05 M % $KI_3$ from $KI_3$ Solution R=1.0)

The emulsion was precipitated similar to Emulsion G, except that the $KI_3$ solution was prepared from a mixture of KI and $I_2$ at the molar ratio of $KI/I_2$ R=1/1, and 0.05 M % $KI_3$ was used in the iodide dump operation. A total of 10 moles AgCl/I was prepared in the form of a monodispersed tetradecahedral grain with an average grain size of 0.78 μm.

Emulsion I (Example of AgCl/I Emulsion, 0.05 M % $KI_3$ from $KI_3$ Solution R=4.0)

The emulsion was prepared similar to Emulsion G except the $KI_3$ solution was prepared from a mixture of KI and $I_2$ at the molar ratio of $KI/I_2$ R=4/1, and 0.05 M % $KI_3$ was used in the iodide dump operation. A total of 10 moles AgCl/I was prepared in the form of a monodispersed tetradecahedral grain with an average grain size of 0.77 μm.

Emulsion J (Example of AgCl/I Emulsion; 0.05 M % $KI_3$ from $KI_3$ Solution R=10.0)

The emulsion was prepared similar to Emulsion G except that the $KI_3$ solution was prepare from a mixture of KI and $I_2$ at the molar ratio of $KI/I_2$ R=10/1, and 0.05 M % $KI_3$ was used in the iodide dump operation. A total of 10 moles AgCl/I was prepared in the form of a monodispersed tetradecahedral grain with an average grain size of 0.77 μm.

Emulsion K (Example of AgCl/I Emulsion, 0.017 M % $KI_3$ from $KI_3$ Solution R=1.0)

The emulsion was precipitated similar to Emulsion G, except that the $KI_3$ solution was prepared from a mixture of KI and $I_2$ at a molar ratio of $KI/I_2$ R=1/1, and 0.017 M % $KI_3$ was used in the iodide dump operation. A total of 10 moles of AgCl/I was prepared in the form of a monodispersed tetradecahedral grains with an average grain size of 0.76 μm.

Emulsion L (Example of AgCl/I Emulsion, 0.017 M % $KI_3$ from $KI_3$ Solution R=4.0)

The emulsion was precipitated similar to Emulsion G, except that the $KI_3$ solution was prepared from a mixture of KI and $I_2$ at a molar ratio of $KI/I_2$ R=4/1, and 0.017 M % $KI_3$ was used in the iodide dump operation. A total of 10 moles of AgCl/I was prepared in the form of a monodispersed tetradecahedral grains with an average grain size of 0.77 μm.

Emulsion M (Example of AgCl/I Emulsion, 0.017 M % $KI_3$ from $KI_3$ Solution R=10.0)

The emulsion was precipitated similar to Emulsion G, except that the $KI_3$ solution was prepared from a mixture of KI and $I_2$at a molar ratio of $KI/I_2$ R=10/1, and 0.017 M % $KI_3$ was used in the iodide dump operation. A total of 10 moles of AgCl/I was prepared in the form of a monodispersed tetradecahedral grains with an average grain size of 0.77 μm.

Emulsion P (Example of AgCl/I Emulsion, 0.05 M % $CsI_3$ from $CsI_3$ Solution R=1.0)

The emulsion was precipitated similar to Emulsion G, except that the $CsI_3$ solution was prepared from a mixture of CsI and $I_2$at a molar ratio of $CsI/I_2$ R=1/1, and 0.05 M % $CsI_3$ was used in the iodide dump operation. A total of 10 moles of AgCl/I was prepared in the form of a monodispersed tetradecahedral grains with an average grain size of 0.77 μm.

Emulsion Q (Example of AgCl/I Emulsion, 0.05 M % $CsI_3$ from $CsI_3$ Solution R=4.0)

The emulsion was precipitated similar to Emulsion G, except that the $CsI_3$ solution was prepared from a mixture of CsI and $I_2$at a molar ratio of $CsI/I_2$ R=4/1, and 0.05 M % $KI_3$ was used in the iodide dump operation. A total of 10 moles of AgCl/I was prepared in the form of a monodispersed tetradecahedral grains with an average grain size of 0.77 μm.

Emulsion R (Example of AgCl/I Emulsion, 0.05 M % $CsI_3$ from $CsI_3$ Solution R=10.0)

The emulsion was precipitated similar to Emulsion G, except that the $CsI_3$ solution was prepared from a mixture of CsI and $I_2$at a molar ratio of $CsI/I_2$ R=10/1, and 0.05 M % $CsI_3$ was used in the iodide dump operation. A total of 10 moles of AgCl/I was prepared in the form of a monodispersed tetradecahedral grains with an average grain size of 0.77 μm.

Emulsion S (Example of AgCl/I Emulsion, 0.017 M % $CsI_3$ from $CsI_3$ Solution R=1.0)

The emulsion was precipitated similar to Emulsion G, except that the $CsI_3$ solution was prepared from a mixture of CsI and $I_2$ at a molar ratio of $CsI/I_2$ R=1/1, and 0.017 M % $CsI_3$ was used in the iodide dump operation. A total of 10 moles of AgCl/I was prepared in the form of a monodispersed tetradecahedral grains with an average grain size of 0.76 μm.

Emulsion T (Example of AgCl/I Emulsion, 0.017 M % $CsI_3$ from $CsI_3$ Solution R=4.0)

The emulsion was precipitated similar to Emulsion G, except that the $CsI_3$ solution was prepared from a mixture of CsI and $I_2$ at a molar ratio of $CsI/I_2$ R=4/1, and 0.017 M % $CsI_3$ was used in the iodide dump operation. A total of 10 moles of AgCl/I was prepared in the form of a monodispersed tetradecahedral grains with an average grain size of 0.76 μm.

Emulsion U (Example of AgCl/I Emulsion, 0.017 M % $CsI_3$ from $CsI_3$ Solution R=10.0)

The emulsion was precipitated similar to Emulsion G, except that the $CsI_3$ solution was prepared from a mixture of CsI and $I_2$at a molar ratio of $CSI/I_2$ R=10/1, and 0.017 M % $CsI_3$ was used in the iodide dump operation. A total of 10 moles of AgCl/I was prepared in the form of a monodispersed tetradecahedral grains with an average grain size of 0.76 μm.

Emulsion V (Example of AgCl/I Emulsion, 0.2 M % $KI_3$ Dumped at 50% of Ag)

A stirred tank reactor containing 8.764 Kg of distilled water and 251 g of bone gelatin was brought to a pAg of 7.15 with 2.0 M solution of NaCl. The mixture was heated to 68.3° C. when 1,8-dihydroxy-3,6-dithiaoctane (1.89 g) was added to the reactor 30 s before the double jet addition of a solution of 3.722 M $AgNO_3$ (at 74.13 mL per min) and a solution of 3.8 M NaCl at a rate such that a constant pAg of 7.15 was maintained. The silver jet addition rate was remained at 39.9 mL per min for 22.66 min when a $KI_3$ solution of molar ratio R=$KI/I_2$=2.687 at a 0.2 M % $KI_3$ was pumped into the tank in 3 minutes. The silver jet addition rate was maintained at 74.13 mL for another 22.5 minutes while the salt stream was adjusted such that the pAg was held constant at 7.15. A total of 12.46 mole AgCl/I was precipitated in the form of a monodispersed cubic grain emulsion having a mean grain size of 0.63 μm.

Emulsion W (Example of AgCl/I Emulsion, 0.2 M % $KI_3$ Dumped at 100% of Ag)

The emulsion was prepared similar to Emulsion V except the $KI_3$ solution was dumped at the end of the Ag-run. A total 12.46 mole AgCl/I emulsion was precipitated in the form of a monodispersed cubic grain emulsion having a mean grain size of 0.65 μm.

Emulsion Y (Example of AgCl/I Emulsion, 0.2 M % $KI_3$ Dumped at 93% of Ag)

The emulsion was prepared similar to Emulsion V except the $KI_3$ solution was dumped at 93% of of the Ag. A total 12.46 mole AgCl/I emulsion was precipitated in the form of a monodispersed cubic grain emulsion having a mean grain size of 0.64 μm.

PART II. EMULSION SENSITIZATION

In accordance with the present invention, a 0.30 mole each of emulsions A through Y (except D) was sensitized with a colloidal suspension of aurous sulfide (4.6 mg/Ag mol) mole for 6 min at 40° C. Then at 60° C., a blue spectral sensitizing dye, anhydro-5-chloro-3,3'-di(3-sulfopropyl) naphtho[1,2-d]thiazolothiacyanine hydroxide triethylammonium salt (220 mg/Ag mol), and 1-(3-acetamidophenyl)-5-mercaptotetrazole (103 mg/Ag mol) were added to the emulsion which was held at this temperature for 27 minutes. The emulsion further contained a yellow dye-forming coupler alpha-(4-(4-benzyloxy-phenylsulfonyl)phenoxy)-alpha (pivalyl)-2-chloro-5-(gamma-(2,4-di-5-amylphenoxy) butyramido)acetanilide (1.00 g/$m^2$) in di-n-butylphthalate coupler solvent (0.27 g/$m^2$), gelatin (1.51 g/$m^2$). The emulsion (0.26 g Ag/$m^2$) was coated on a resin coated paper support and 1.76 g/$m^2$ gel overcoat was applied as a protective layer along with the hardener bis (vinylsulfonyl) methyl ether in an amount of 1.8% of the total gelatin weight.

Emulsion D was sensitized similar to above except potassium iodide or cesium triiodide in amounts indicated in Table II was added before aurous sulfide.

PART III. EMULSION PROCESSING

The coatings were given a 0.1 second exposure, using a 0–3 step tablet (0.15 increments) with a tungsten lamp designed to stimulate a color negative print exposure source. This lamp had a color temperature of 3000 K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.), and stabilization or water wash (90 sec, 35° C.) followed by drying (60 sec, 60° C.). The chemistry used in the Colenta processor consisted of the following solutions:

| | |
|---|---|
| Developer: | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Acetic acid | 9.0 mL |
| Water to total 1 liter, pH adjusted to 6.2 | |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Stabilizer | |
| Sodium citrate | 1 g |
| Water to total 1 liter, pH adjusted to 7.2. | |

PART IV. EMULSION SENSITOMETRY

Example 1

Data in Table I show the speed and fog density of the blue sensitized coatings for the pure chloride emulsion and the silver iodochloride emulsions using iodine as the iodide source. The speed taken at the 1.0 density point of the D log E curve is taken as a measure of the sensitivity of the emulsion. D-min is measured as the minimum density above zero.

TABLE I

| Sample | Emulsion | Halide type | I source | mol % | Speed | Fog |
|---|---|---|---|---|---|---|
| 1 (comparison) | A | AgCl | none | 0 | 130 | 0.070 |
| 2 (comparison) | B | AgICl | KI | 0.3 M KI | 198 | 0.280 |
| 3 (invention) | C | AgICl | $CsI_3$ | 0.3 M $CsI_3$ | 161 | 0.080 |

It can be seen from data in Table I that the sample of the present invention (sample 3) has significantly higher speed and similar fog than the comparison emulsion (sample 1) that has no iodide in the silver chloride grain. When compared with the emulsion made with KI (sample 2), the invention sample is much lower in fog.

Example 2

This is an example of the use of the triiodides of the invention used during sensitization. This example compares the speed and fog parameters of a silver chloride emulsion that is sensitized in the presence of cesium triiodide relative to potassium iodide. It can be seen from data in Table II that the emulsions sensitized with 0.1 and 0.2 mol % iodide with $CsI_3$ (samples 6 and 7) have higher speed than coatings that are sensitized with KI emulsions (samples 4 and 5) and still maintain low fog.

TABLE II

| Sample | Emulsion | Halide type | I source | Mol % | Speed | Fog |
|---|---|---|---|---|---|---|
| 4 (comparison) | D | AgCl | KI | 0.1 | 58 | 0.060 |
| 5 (comparison) | D | AgCl | KI | 0.2 | 65 | 0.060 |
| 6 (invention) | D | AgCl | $CsI_3$ | 0.1 | 138 | 0.060 |
| 7 (invention) | D | AgCl | $CsI_3$ | 0.2 | 137 | 0.060 |

Example 3

This example compares silver iodochloride emulsions that are made using various alkali triiodides as the iodide source.

TABLE III

| Sample | Emulsion | Halide type | I source | $I_3$, mol % | Speed | Fog |
|---|---|---|---|---|---|---|
| 7 (comparison) | A | AgCl | none | 0 | 130 | 0.07 |
| 8 (invention) | E | AgICl | $CsI_3$ | 0.003 | 182 | 0.06 |
| 9 (invention) | F | AgICl | $RbI_3$ | 0.003 | 185 | 0.07 |
| 10 (invention) | G | AgICl | $KI_3$ | 0.003 | 183 | 0.07 |

It can be seen from Table III that all the alkali triiodides show similar speed fog positions and higher sensitivity (samples 8–10) than the comparison (sample 7) which has no iodide.

Example 4

This example compares the performance of coatings of silver iodochloride emulsions that are made with triiodides ($KI_3$ and $CsI_3$) which are prepared from their corresponding alkali iodides and iodine.

TABLE IV

| Sample | Emulsion | I source | AgI, mol % | mol ratio $I/I_2$ | Speed | Fog |
|---|---|---|---|---|---|---|
| 7 (comparison) | A | none | 0.0 | 0 | 130 | 0.07 |
| 11 (invention) | H | $KI^3$ | 0.9 | 1 | 183 | 0.07 |
| 12 (invention) | I | $KI^3$ | 0.9 | 4 | 189 | 0.08 |
| 13 (invention) | J | $KI^3$ | 0.9 | 10 | 189 | 0.09 |
| 14 (invention) | K | $KI^3$ | 0.3 | 1 | 169 | 0.06 |
| 15 (invention) | L | $KI^3$ | 0.3 | 4 | 188 | 0.09 |
| 16 (invention) | M | $KI^3$ | 0.3 | 10 | 189 | 0.09 |
| 17 (invention) | P | $CsI^3$ | 0.9 | 1 | 182 | 0.06 |
| 18 (invention) | Q | $CsI^3$ | 0.9 | 4 | 185 | 0.08 |
| 19 (invention) | R | $CsI^3$ | 0.9 | 10 | 188 | 0.09 |
| 20 (invention) | S | $CsI^3$ | 0.3 | 1 | 177 | 0.06 |
| 21 (invention) | T | $CsI^3$ | 0.3 | 4 | 185 | 0.08 |
| 22 (invention) | U | $CsI^3$ | 0.3 | 10 | 190 | 0.09 |

It can be seen in Table IV that the emulsions of the present invention (samples 11–22) show a range of speed fog positions depending on the mol percent of AgI and the ratio of iodide to iodine. These speed fog positions are obtained when the emulsion is precipitated with either one of the triiodides, the pre-isolation of which is not necessary. The triiodides may be prepared easily and conveniently from the readily available alkali iodides and iodine.

Example 5

This example compares the performance of the coatings of silver iodochloride emulsions that are made with $KI_3$. The triiodide is introduced in the kettle at various points of precipitation as a percentage of total silver used for the make.

TABLE V

| Sample | Emulsion | $KI_3$ dumped @ % Ag | Speed | Fog |
|---|---|---|---|---|
| 23 (invention) | V | 50 | 103 | 0.06 |
| 24 (invention) | Y | 93 | 161 | 0.06 |
| 25 (invention) | W | 100 | 137 | 0.06 |

It can be seen from Table V that the triiodide can be introduced at any point during the precipitation of silver iodochloride emulsions. But it is preferred that the triiodide be introduced at or near 93% of the total silver consumed.

The invention has been described in detail with particular reference to certain preferred embodiments thereof, but it will be understood that variations and modifications can be effected within the spirit and scope of the invention.

What is claimed is:

1. A method of forming a silver halide emulsion comprising adding triiodide during grain formation or sensitization.

2. The method of claim 1 wherein triiodide addition is at after 90 percent of silver addition in emulsion formation.

3. The method of claim 1 wherein 0.03 to 0.5 mol percent of said triiodide per mole of silver is added.

4. The method of claim 1 wherein the source of triiodide is cesium triiodide.

5. The method of claim 1 wherein triiodide addition is at a pH of between 5 and 6.

6. The method of claim 1 wherein triiodide addition is at a temperature between 60 and 66° C.

7. The method of claim 1 wherein triiodide addition is at vAg of 100 to 120 millivolts.

8. The method of claim 1 wherein triiodide addition is during chemical sensitization.

9. The method of claim 1 wherein the emulsion formed by the method comprises silver halide grains and said grains have a halide composition of at least 90 percent chloride.

10. The method of claim 1 wherein triiodide addition is during grain formation.

11. The method of claim 1 wherein said triiodide is added between 1 and 50 seconds after between 50 and 100 percent of the silver in said silver halide emulsion has been added during grain formation.

12. The method of claim 2 wherein the silver halide emulsion comprises silver chloride grains formed by the method, and said silver chloride grains comprise at least 99 percent silver chloride with the remainder being substantially silver iodide.

13. The method of claim 1 wherein the source of triiodide is rubidium triiodide.

14. The method of claim 1 wherein the source of triiodide is potassium triiodide.

15. The method of claim 1 wherein said triiodide is added when about 0.00166 percent to 1 percent of total silver halide for forming said silver halide emulsion has been precipitated.

16. The method of claim 1 wherein said triiodide is added when about 0.01 to 0.166 mole percent of total silver halide for forming said silver halide emulsion has been precipitated.

17. The method of claim 1 wherein triiodide is added after 85 mol percent of total silver halide for forming said silver halide emulsion has been precipitated.

18. The method of claim 6 wherein all triiodide is added between after 90 mole percent to 97 mole percent of total silver chloride for forming said silver halide emulsion has been precipitated.

19. The method of claim 1 wherein said grain formation comprises precipitating carried out at a pH of between 5 and 6.

20. The method of claim 1 wherein grain formation is carried out at a temperature of between 50 and 70° C.

21. The method of claim 1 wherein all triiodide is added during grain formation in a period of between 1 and 30 seconds.

22. The method of claim 1 wherein all of said triiodide is added during grain formation in a time of between 1 and 10 seconds.

* * * * *